United States Patent [19]

Bond

[11] Patent Number: 4,557,130

[45] Date of Patent: Dec. 10, 1985

[54] HOUSINGLESS BEAM MILL STAND

[75] Inventor: Harry L. F. Bond, Hathersage Nr. Sheffield, England

[73] Assignee: Davy McKee (Sheffield) Limited, Yorkshire, England

[21] Appl. No.: 526,169

[22] Filed: Aug. 25, 1983

[30] Foreign Application Priority Data

| | | | |
|---|---|---|---|
| Aug. 25, 1982 | [GB] | United Kingdom | 824445 |
| Oct. 29, 1982 | [GB] | United Kingdom | 8231034 |
| Mar. 22, 1983 | [GB] | United Kingdom | 8307822 |

[51] Int. Cl.[4] ..... B21B 13/10; B21B 31/04; B21B 31/24; B21B 31/08

[52] U.S. Cl. ..... 72/225; 72/237; 72/238; 72/248

[58] Field of Search ..... 72/225, 237, 238, 224, 72/248

[56] References Cited

U.S. PATENT DOCUMENTS

| | | | |
|---|---|---|---|
| 3,098,404 | 7/1963 | Morath et al. | 72/225 |
| 3,899,910 | 8/1975 | Aramaki | 72/225 X |
| 3,938,362 | 2/1976 | Falk et al. | 72/225 |
| 3,948,072 | 4/1976 | Aramaki | 72/225 |
| 4,127,997 | 12/1978 | Quehen | 72/225 X |

*Primary Examiner*—Francis S. Husar
*Assistant Examiner*—Steven B. Katz
*Attorney, Agent, or Firm*—Lee, Smith & Zickert

[57] ABSTRACT

A housingless beam mill stand is described in which horizontal rolls are mounted in chocks which are prestressed against a rectangular frame by tension bolts which pass through the chocks and the frame, in conjunction with the prestressing cylinder. Vertical rolls are carried by roll chocks which have clearance ways through which the tension bolts also pass, and which permit lateral adjustment of the vertical roll chocks and thus the vertical rolls.

10 Claims, 17 Drawing Figures

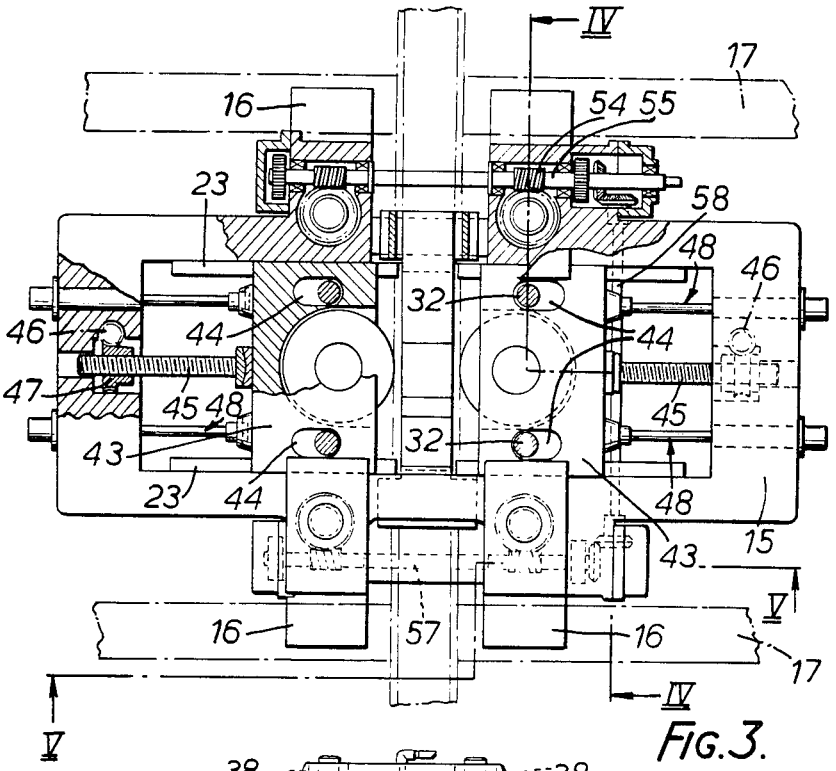
FIG. 3.
FIG. 4.
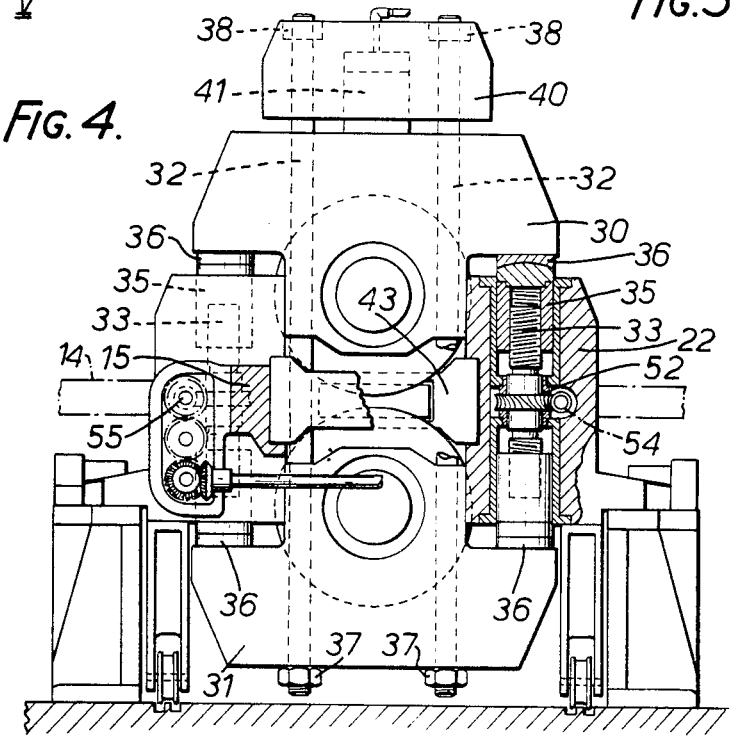

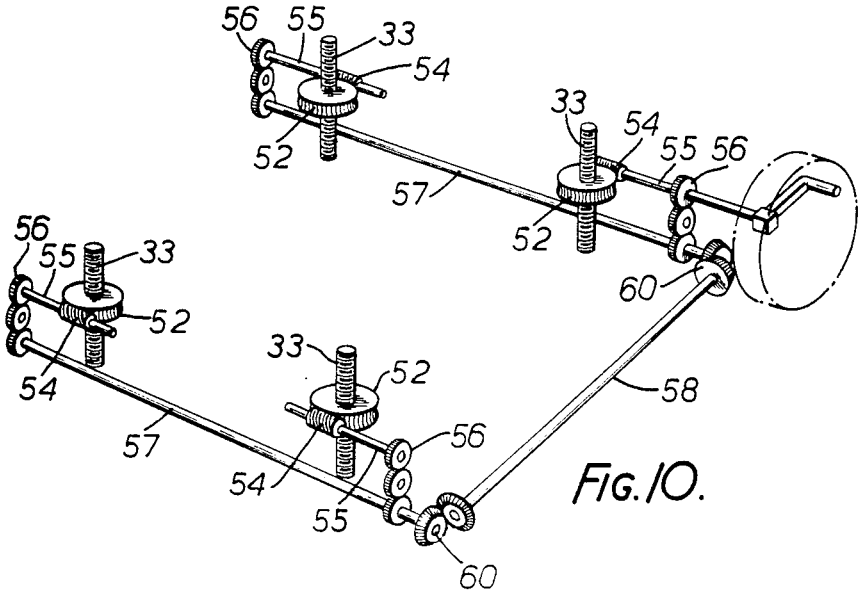
FIG. 10.
FIG. 11.
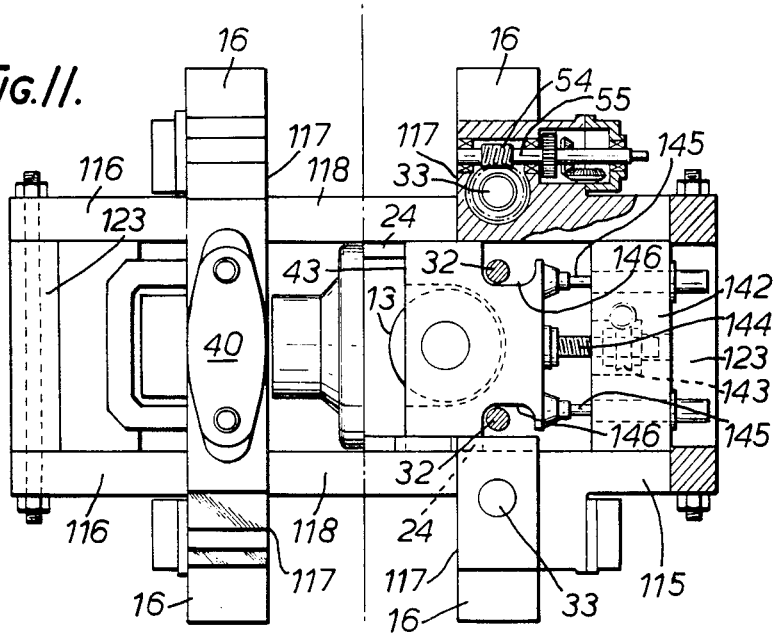

HOUSINGLESS BEAM MILL STAND

This invention relates to a housingless beam mill stand of the type having a pair of horizontal rolls and a pair of vertical rolls forming between them a roll gap of beam section. The invention also relates to such a beam mill which may be used for temporarily rolling section product.

One object of the invention is to provide a unitary and compact stand structure. Another object of the invention is to enable the horizontal rolls to be prestressed.

According to the invention there is provided, a housingless beam mill stand comprising: a frame of substantially rectangular form; upper and lower chocks for upper and lower horizontal rolls located on opposite sides of the frame; infinitely variable roll gap adjustment means mounted in or on the frame and acting effectively between the frame and the horizontal roll chocks; prestressing tension bolts acting between upper and lower horizontal roll chocks and passing through the space defined by the frame, whereby the adjustment means are preloaded; a pair of cooperating and opposed vertical rolls; and two chocks in which the respective vertical rolls are journalled, which are adjustably mounted on the frame to permit variation of the vertical roll gap, and which are shaped to accommodate the tension bolts while permitting adjustment movement of the chocks lengthwise of the frame.

The adjusting means for the blocks may be coupled together so that they are adjusted together. Thus, synchronising shafts connecting the adjusting means may be provided, those shafts being displaced from the stand passline, by the employment for example of a gear train connecting the adjusting means of each block at the level of the pass-line with a synchronising shaft below that level.

Figure 1:
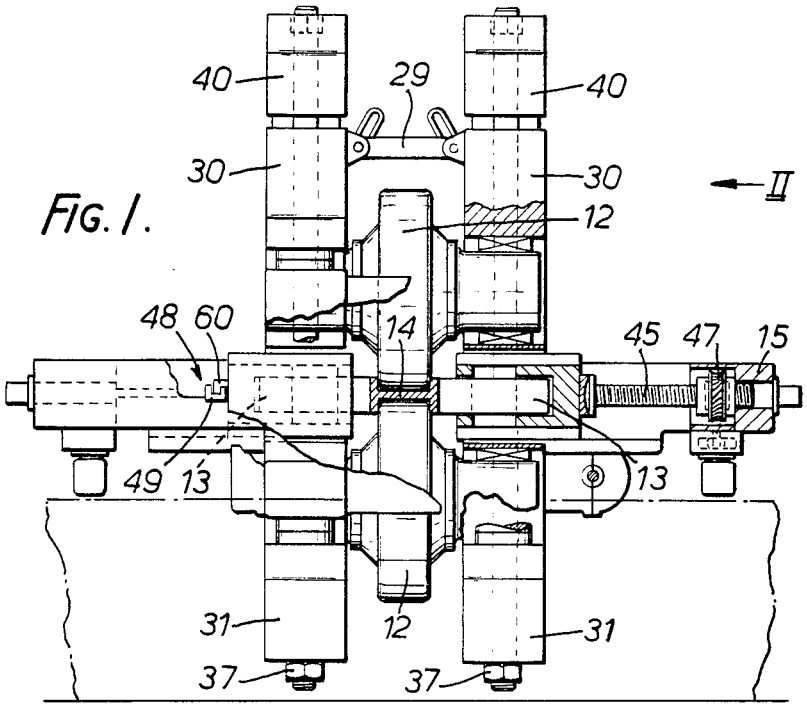
Figure 2:
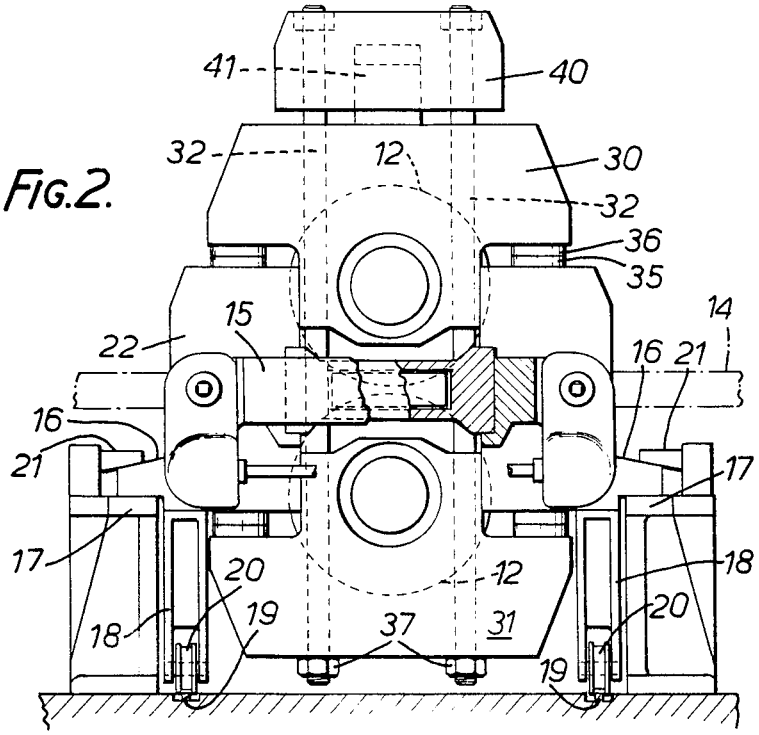
Figure 5:
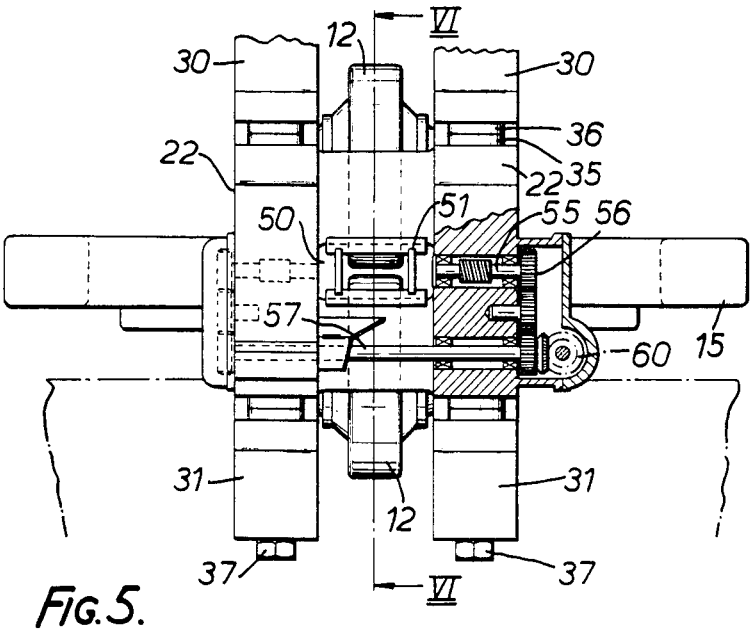
Figure 6:
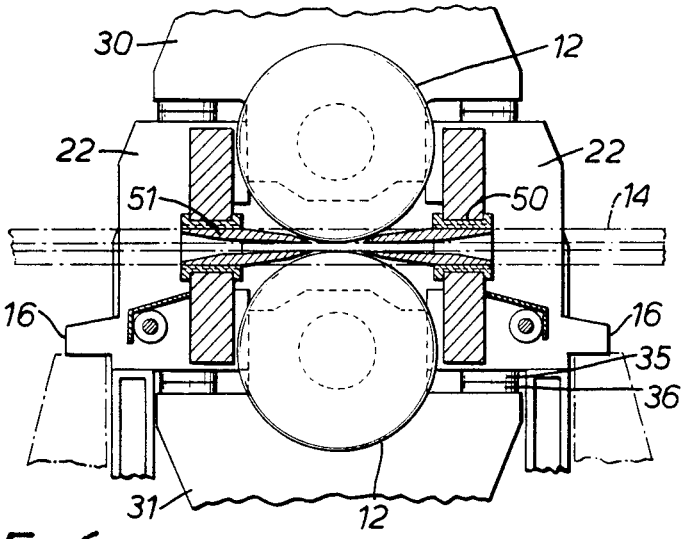
Figure 7:
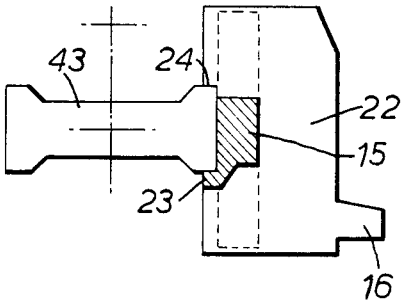
Figure 8:
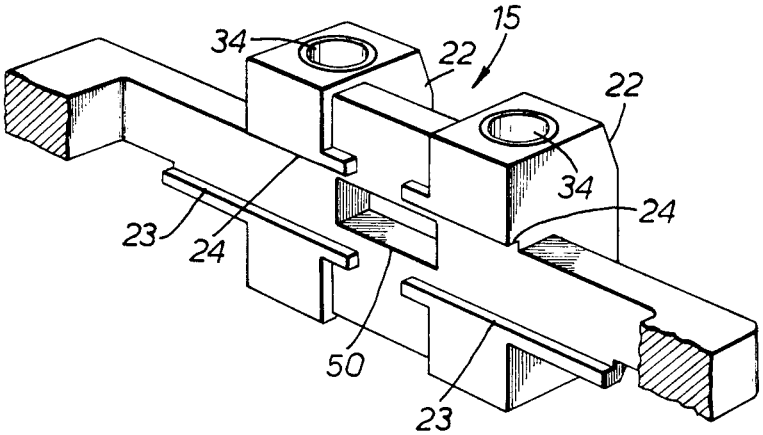
Figure 9:
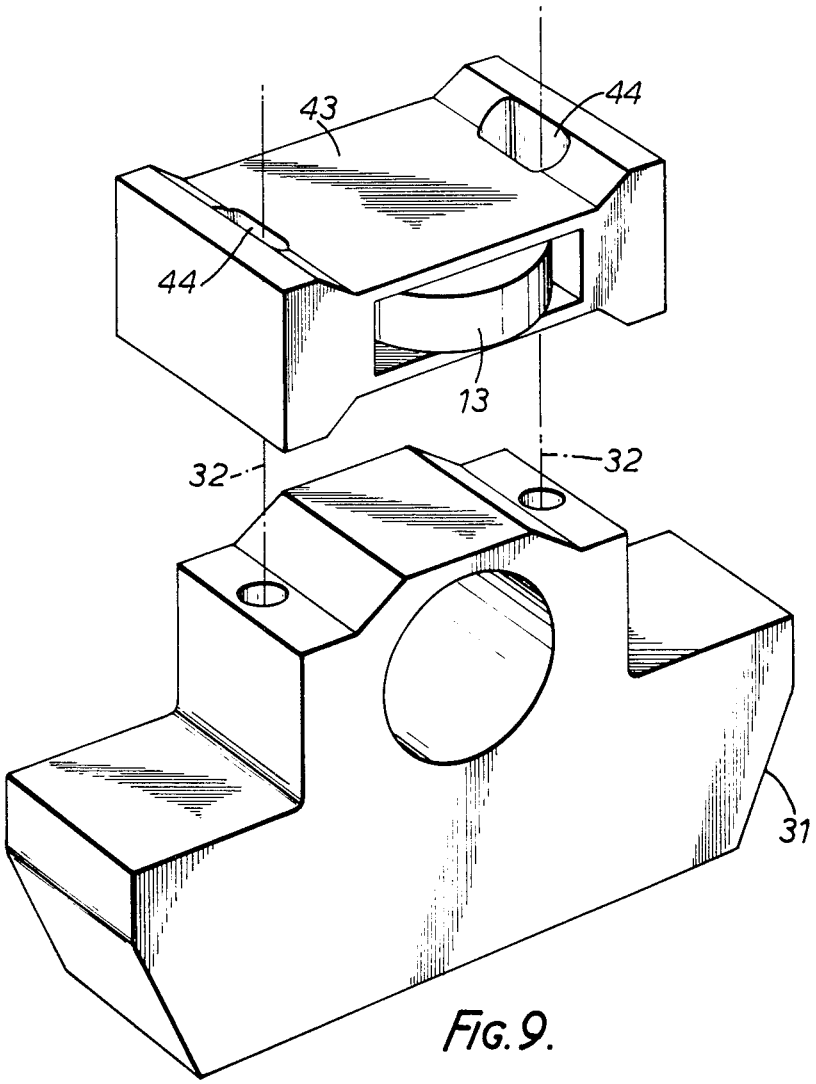
Figure 12:
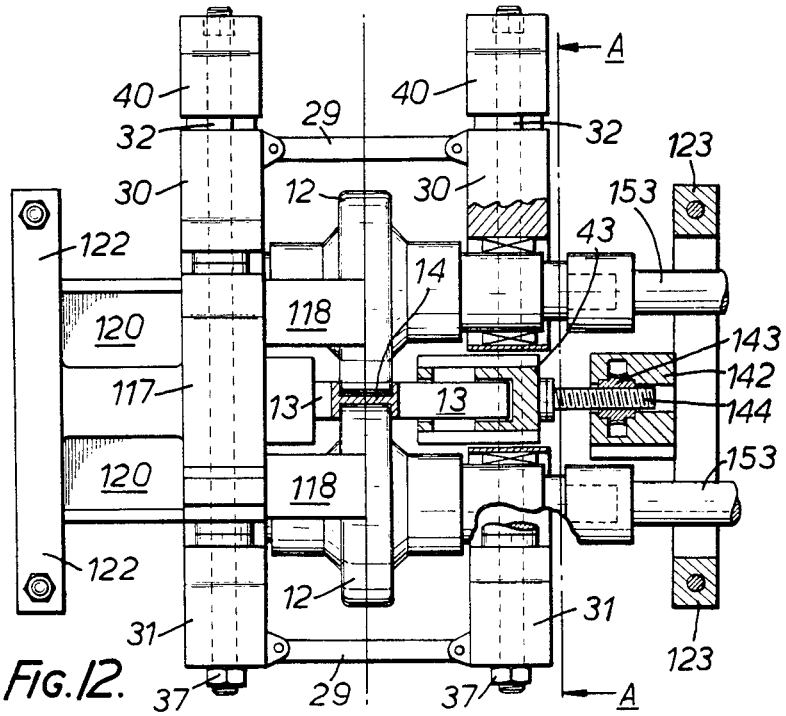
Figure 13:
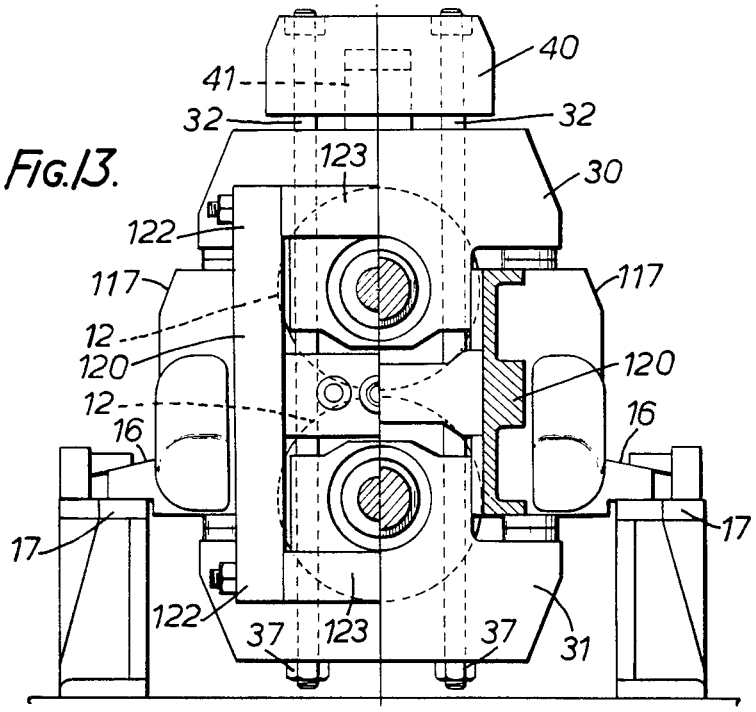
Figure 14:
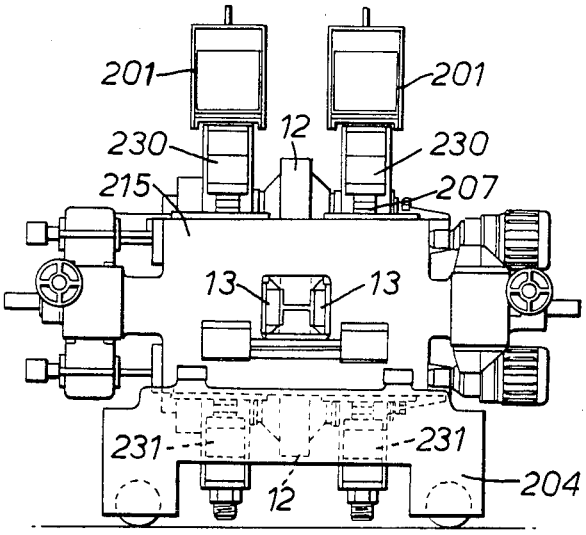
Figure 15:
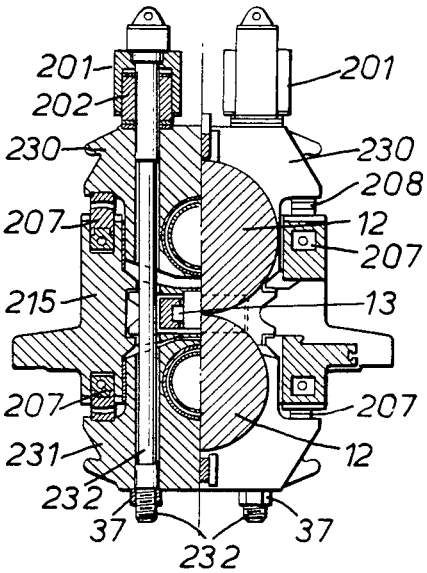
Figure 16:
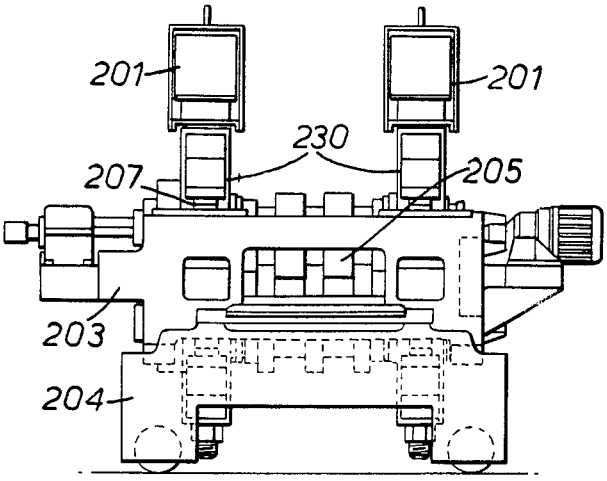
Figure 17:
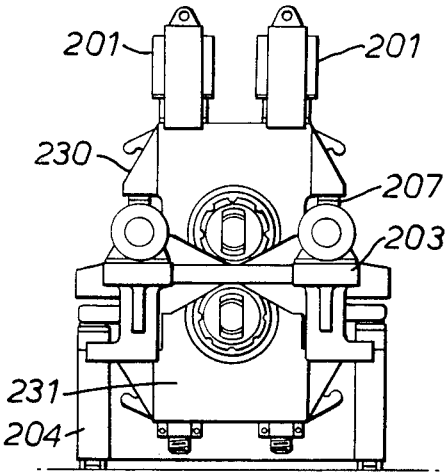

The invention will be more readily understood by way of example from the following description of embodiments of a beam mill stand in accordance therewith, and the accompanying drawings, in which:

FIG. 1 is an elevation of a beam mill stand of a first embodiment, with parts broken away, FIG. 2 is a view of the stand in the direction of the arrow II of FIG. 1, FIG. 3 is a part sectional plan view, FIGS. 4 and 5 are sections on the line IV—IV and V—V of FIG. 3, FIG. 6 is a section on the line VI—VI of FIG. 5, FIG. 7 illustrates the mounting of a vertical roll chock in the frame, FIG. 8 is a perspective view of a part of the frame, FIG. 9 illustrates a vertical roll chock in relation to a horizontal roll chock, FIG. 10 is a perspective view of the synchronising mechanism, FIG. 11 is a plan view, the right hand part showing a beam mill according to a second embodiment, with the upper roll assembly removed and in part section, FIG. 12 is a front view of the mill of FIG. 11, the left hand part showing the mill in elevation and the right hand part being a vertical section on the centre line of the mill, FIG. 13 is an end view of the mill of FIG. 11, the left hand part being an end elevation and the right hand part a section on the line A—A of FIG. 1, FIGS. 14 and 15 are side and end views of a beam mill stand according to a further embodiment, and FIGS. 16 and 17 show in side view and end view respectively the stand of the further embodiment arranged for section rolling.

Reference will now be made to the drawings, wherein like numerals indicate like parts.

The beam mill stand illustrated in FIGS. 1 to 10 of the drawings has, in common with other such mills, a pair of horizontal rolls 12 and a pair of vertical rolls 13 which, between them, form an ingoing billet into beam section, as shown at 14 in FIG. 1.

The stand has an oblong frame 15 having two pairs of integral feet 16, which, when the mill is properly positioned in the rolling line, rest on a pair of spaced bedplates 17, as best shown in FIG. 2, the stand being held firmly on the bedplates by clamps 21. Feet 16 carry downwardly projecting trunnions 18 mounting wheels 20 which when the mill is in operation are clear of rails 19, but which can be brought into engagement with the rails to enable the stand to be run into and out of the rolling line. The rails are ramped so that as the stand is moved axially along its bedplates to move it out of the rolling line, the wheels come into engagement with the rails at the ramps and the weight of the stand is transferred from the bedplates to the rails.

The frame is best illustrated in FIG. 8. As there is shown, the frame 15 which may be a single casting including the feet 16, the frame generally having a square cross section. Centrally of each longer side of the frame there are two spaced upstanding blocks 22 from which the feet 16 extend. Adjacent those blocks and on the inner side, the frame is formed on each side with a pair of inwardly extending ribs 23 which extend beyond the blocks 22. A shoulder 24 vertically displaced from the ribs 23 is similarly formed on each block 22. The faces of the ribs 23 and shoulders 24, and the face of the frame 15 therebetween form a guideway.

The horizontal mill part of the mill stand is prestressed. Each roll 12 is journalled in a pair of T-shaped chocks 30 and 31, which are bored to receive four vertical tensioning bolts 32. The upper chocks 30 are tied together by a link 29 (FIG. 1). The chocks, with their rolls 12, are supported and guided by the four blocks 22 each of which carries a vertically arranged double-ended screw 33 mounted in a bore 34. Each end of each screw 33 is threaded in a plunger 35, partly located in the bore 34 and held against rotation. Each plunger 35 in turn carries a self aligning pad 36 engaging the outwardly extending faces of the chocks 30, 31.

At the lower ends, the tensioning bolts 32 carry nuts 37 engaged with the underside of the lower chock 31. At their upper ends, the bolts 32 have similar nuts 38 received in openings in crossheads 40. Each crosshead incorporates a piston and cylinder device 41, of which the piston engages the upper face of one of the upper chocks 30. By applying liquid under pressure to the piston and cylinder device 41, the bolts 32 are tensioned and the chocks 30, 31 held in engagement with the pads 36 of the screw adjusting mechanisms 33, 35.

Coming now to the vertical part of the beam mill stand, each of the vertical rolls 13 is journalled in, and partially enclosed within, a single chock 43 (see particularly FIG. 9). Each vertical chock is mounted horizontally within the frame 15, being slidably supported by the guideway constituted by the ribs 23 and the shoulders 24. When in the operative positions shown in the drawings, the chocks 43 are thus restrained vertically.

The vertical chocks 43, together with their rolls 13 can however be adjusted horizontally relative to one another, within the confines of the frame 15, by any convenient means; screw jacks 45 are illustrated in the drawings, each screw jack being driven by a motor through a gear box and a worm 46 and worm wheel 47 (FIGS. 1 and 3). Pull back piston and cylinder assemblies 48, which pull the chocks away from one another when the screw jacks 45 are withdrawn outwardly, are also carried in the frame 15. As shown in FIG. 1, each piston rod of the four piston and cylinder assemblies 48 carries a latch 49 which engages with a hook 60 on the respective chock 43; that arrangement enables the vertical roll chocks to be removed vertically from the stand without the need to disconnect them mechanically from the assemblies 43.

To enable the roll gap between the vertical rolls 13 to be adjusted, each chock 43 is formed with clearance ways illustrated as a pair of vertical slots 44, through which the tensioning bolts 32 pass (FIGS. 3 and 9).

A window 50 is formed through each side of the frame 15 between the blocks 22, to permit passage of the work to, and away from, the roll gap between the horizontal rolls and vertical rolls. The two windows receive guides 51 (FIG. 6).

Roll gap adjustment for the horizontal rolls 12 is achieved by the four double ended screws 33, each of which is centrally formed with a wormwheel 52 meshing with a worm 54 on a drive shaft 55. The four drive shafts 55 are connected through gear trains and synchronising shafts which are best illustrated in FIG. 10. As there shown, each drive shaft 55 carries the uppermost gear 56 of a vertically arranged three-gear train, the lowermost gear of which is carried on a synchronising shaft 57 extending parallel to the axis of the horizontal rolls 12 and at a level below the pass-line window 50. The two synchronising shafts 57 are themselves coupled by a third synchronising shaft 58 and bevel gears 60, shaft 58 extending at right angles to shafts 57 and lying below the level of the frame 15. One of the four drive shafts 55 is the input shaft and is coupled to a drive mechanism (not shown). On rotation of that shaft by the drive mechanism, all four shafts 55 are driven in synchronism and all eight plungers 35 are extended or retracted equally from or into the blocks 22. By virtue of the three-gear trains, the synchronising shafts 57 and 58 are removed from the level of the pass-line, so that, firstly, the shafts 57 do not obstruct the work and, secondly, the shaft 58 is located clear of the frame 15.

When the rolls 12, 13 require replacing, the clamps 21 are released and the stand is run out of the mill line to the roll shop. A replacement stand may then take the place of the stand in the line.

In the roll shop, nuts 37 are removed and the crossheads and bolts 32 withdrawn. The horizontal rolls 12 with their chocks can now be lifted away. To remove the vertical rolls 13, the chocks 43 are displaced outwardly to free them from the shoulders 24 and are then lifted out of the frame 115. A new or refurbished set of rolls 12, 13 with their chocks may then be introduced into the stand.

An alternative embodiment of roll chocks is shown in FIG. 11 which will be referred to in detail later in relation with another embodiment of the beam mill. As before each of the vertical rolls 13 is journalled in, and partially enclosed within, a single chock 43. Each vertical chock 43 is mounted horizontally within the frame 115, being horizontally slidably supported by the guideway constituted by shoulders 24 and being restrained by those ribs in the upwards and downwards directions. For the adjustment of the vertical rolls 13, a beam 142 attached to the frame 115 incorporates a nut 143 and screw 144, the latter engaging the chock 43, and balance piston and cylinder units 145. Each chock 43 has cut-out rebates 146 accommodating the tension bolts 32 and permitting horizontal adjustment of the chocks. It will be apparent that this form of vertical roll chock may be used with the beam already described, and can be used with those now to be described.

As an additional advantage the beam mill which has been described may be converted temporarily for use in rolling section product. This may be accomplished in one of two ways. First, the frame used for beam rolling may be adapted to receive, after removal of the horizontal and vertical beam rolls, the section rolls and operate as a two-high mill, or second, a frame particularly adapted for use in section rolling may be substituted for the frame used for beam rolling.

A beam mill stand with a frame adapted for the first of these alternatives is illustrated in FIGS. 11, 12 and 13. The embodiment of FIGS. 11, 12 and 13 differs from that previously described in that the frame 115, though generally oblong as before, is formed on each side of the mill by tensions members 116, each of which incorporates two spaced upstanding blocks 117 from which feet 16 extend. The blocks 117 incorporate a (horizontal) roll gap adjustment mechanism as for the previously described embodiment. Between each pair of blocks 117, the tension members comprise a pair of vertically spaced beams 118 (FIG. 12), while outside the blocks 117 the tension members are constituted by beams 120, which have the cross-section shown in FIG. 13 and which extend vertically between the levels of the beams 118. At their extremities, the beams 120 have in-turned lips and are extended vertically upwards and downwards, forming extensions 122. The frame also includes transverse ties 123 extending at right angles to the axes of the rolls 12 and which are bolted to the extensions 122. Finally, the beams 18 and 20 have shoulders 24 and 25, which form guides for the vertical roll chocks 43. As before the mill is pre-stressed by tension bolts 32.

As will be appreciated, the frame 115 is so designed that, at each ends, there is a rectangular opening bounded by the ties 123 and the ends of the beams 120, incorporating the extensions 122. Bacause of the need to accommodate the vertical rolls adjustment gear (142–145) between horizontal roll drive spindles 153, the horizontal rolls 12 must have a relatively large diameter as shown in order to get the requisite spacing between the spindles 153. The ties 123 are so spaced apart vertically as to accommodate the spindles 153 when at their maximum separation for the mill in its beam mill configuration. The horizontal spacing between the blocks 117 is determined by the barrel length of the section mill rolls when the mill is being used as a section mill. Those section mill rolls (not shown) have a relatively small diameter and a barrel length normally greater than that of beam mill horizontal rolls and, for the latter reason, the beam mill rolls are formed with extended necks as shown. The horizontal displacement between the ties 123 is selected to allow the horizontal rolls to be removed from, and introduced to, the mill in a vertical direction, without fouling those ties 123.

Because the section mill rolls have a relatively small diameter, the drive spindles 153, when the mill is used as a section mill must be relatively close together and therefore the vertical rolls screw down gear and the vertical rolls themselves 142–145 must be removed when transforming the mill from a beam mill to a section mill. Again, the horizontal separation of the ties 123 is selected to allow the vertical roll adjustment gear to be removed vertically, without fouling the ties 123.

Two sets of rolls could be used with this stand. The first, for use when the mill operates as a beam mill, consists of the horizontal rolls 12 and their chocks 30, and the vertical rolls 13 with their chocks 43 and their adjustment gear 142–145. The second set consists of the section mill (horizontal) rolls with their chocks 30–31. When it is desired to convert from, for example, the beam mill configuration to the section mill configuration, the pre-stressing is released, and the cross-heads 40 and the bolts 32 are removed. The spindles 153 are released from the necks of the horizontal rolls and the upper chocks 30 with the upper roll 12 are lifted away vertically. The lower chocks 31 and lower roll 12 are similarly lowered and removed. Next, the beams 142 are released from the beams 120, if bolted thereto, and lifted away vertically and the vertical rolls in their chocks are similarly removed, leaving only the frame 115 sitting on the back plates 17. The horizontal section mill rolls already journalled in their chocks (30 and 31) are then brought to the mill and lowered, or raised, so that the chocks engage the blocks 117. The cross-heads 40 and their bolts 32 are assembled and secured to the chocks and, finally, the drive spindles 153 are connected to the necks of the section mill rolls.

In the second alternative for temporarily using the beam mill as a section mill a different frame is used for the section mill rolls, and this is now described with reference to FIGS. 14 to 17 which also illustrates another embodiment of the beam mill.

The beam mill stand illustrated in FIGS. 14 and 15 is essentially similar to that shown in FIGS. 1 to 10 and described previously. It includes a centre encompassing frame 215 in which the chocks for the vertical rolls 13 and the vertical rolls gap adjustment gear are carried. The horizontal rolls 12 are journalled in upper and lower T-headed chocks 230 and 231, which are guided vertically in the frame 215. The chocks 230 and 231 are prestressed on to adjustment devices 207 carried in the frame 215 at the required separation by prestressing means illustrated as comprising tension bolts 232 which pass vertically through the chocks 230, 231. Each tension bolt is engaged with a cylinder 201 of a prestressing piston and cylinder device, the piston 202 of which acts on the respective top chock 230.

The beam mill may be temporarily converted to two-high section mill stand as shown in FIGS. 16 and 17. The section mill stand differs only in the design of the center frame, shown in FIGS. 16 and 17 at 203, in the use of section rolls 205, and in the temporary absence of vertical rolls; the chocks 230 and 231, the prestressing means 232, 201–202, base 204 and the adjustment devices 207 are identical and interchangeable with the corresponding parts in the beam mill stand.

The center frame 203 for the section mill stand differs from center frame 215 in the spacing of the adjustment devices 207 for the two chocks 230 or 231; the section rolls 205 have a substantially greater barrel length than the beam mill horizontal rolls 212 and the separation of the chocks 230 and 231 are correspondingly greater in the section mill stand than in the beam mill stand.

It will thus be seen that a beam mill stand may be temporarily converted to a section mill stand by dismantling the former, mounting the section rolls in the chocks 230, 231 and assembling those rolls in their chocks in a section mill center frame 203. Conversion from a section mill stand back to a beam mill stand can be similarly effected.

It will be appreciated that for the beam mill, the arrangement of the vertical rolls chocks in relation to the tensioning bolts 232 is as for the previously described embodiments. Attention is drawn to the adjustment means of the beam mill of this embodiment where chocks or wedges 208 are used in conjunction with the roll gap adjustments mechanisms 207. The gap adjustments mechanisms 207 are in themselves separate screw arrangements which are connected together by suitable gearing. Also, in this embodiment, individual pretensioning cylinders 201 are used for each tensioning bolt 232, as opposed to the single cylinder and cross-head arrangement for two tensioning bolts described for the other two embodiments.

It will be readily apparent that variation in the design of the frame for the beam mill and of the prestressing of the tension bolts can be made without departing from the scope of the invention as set out in the appended claims.

What is claimed is:

1. A housingless beam mill stand comprising: a frame of substantially rectangular form and including a central space defined by the frame, upper and lower chocks for upper and lower horizontal rolls located on opposite sides of the frame; roll gap adjustment means mounted in or on the frame, said roll gap adjustment means being infinitely variable between defined limits and acting effectively between the frame and the horizontal roll chocks; prestressing tension bolts acting between upper and lower horizontal roll chocks and passing through the space defined by the frame, whereby the adjustment means are preloaded; a pair of cooperating and opposed vertical rolls; and two chocks in which the respective vertical rolls are journalled, said vertical roll chocks being adjustably mounted on the frame to permit variation of the vertical roll gap, and having through passages elongated in one direction, said tension bolts passing through said passages while permitting adjustment movement of the vertical roll chocks lengthwise of the frame.

2. A beam mill stand as claimed in claim 1 wherein the vertical roll chocks are adjustably mounted in guide ways in the frame and the chocks have rebates which with the guide ways form said through passages for passage of the tension bolts.

3. A beam mill stand as claimed in claim 1 wherein the adjusting means includes an adjustment mechanism for each upper and lower horizontal roll chock and these adjustment mechanisms are coupled together so as to be adjusted together.

4. A beam mill stand as claimed in claim 4 wherein the adjustment mechanisms for the upper and lower horizontal roll chocks are coupled to synchronizing shafts displaced from the pass-line by a gear train for each adjustment mechanism.

5. A beam mill stand as claimed in claim 1 wherein said frame is shaped for rolling section and has the adjustment means spaced apart to accommodate the horizontal roll chocks at a horizontal separation commensurate with the barrel length of the horizontal rolls.

6. A beam mill stand as claimed in claim 1 wherein the adjusting means includes an adjustment mechanism for each upper and lower horizontal roll chock and these adjustment mechanisms are coupled together so as to be adjusted together.

7. A beam mill stand as claimed in claim 2 wherein the adjusting means includes an adjustment mechanism for each upper and lower horizontal roll chock and these adjustment mechanisms are coupled together so as to be adjusted together.

8. A beam mill stand as claimed in claim 2 wherein said frame is shaped for rolling section and has the adjustment means spaced apart to accommodate the horizontal roll chocks at a horizontal separation commensurate with the barrel length of the horizontal rolls.

9. A beam mill stand as claimed in claim 3 wherein said frame is shaped for rolling section and has the adjustment means spaced apart to accommodate the horizontal roll chocks at a horizontal separation commensurate with the barrel length of the horizontal rolls.

10. A beam mill stand as claimed in claim 4 wherein said frame is shaped for rolling section and has the adjustment means spaced apart to accommodate the horizontal roll chocks at a horizontal separation commensurate with the barrel length of the horizontal rolls.

* * * * *